US010276022B2

(12) United States Patent
Goodson

(10) Patent No.: US 10,276,022 B2
(45) Date of Patent: Apr. 30, 2019

(54) BREATHING APPARATUS WITH ONE OR MORE SAFETY SENSORS

(71) Applicant: Mark Goodson, Corinth, TX (US)

(72) Inventor: Mark Goodson, Corinth, TX (US)

( * ) Notice: Subject to any disclaimer, the term of this patent is extended or adjusted under 35 U.S.C. 154(b) by 0 days.

(21) Appl. No.: 15/444,874

(22) Filed: Feb. 28, 2017

(65) Prior Publication Data

US 2018/0005505 A1 Jan. 4, 2018

Related U.S. Application Data

(60) Provisional application No. 62/358,082, filed on Jul. 4, 2016.

(51) Int. Cl.

| | |
|---|---|
| ***G08B 23/00*** | (2006.01) |
| ***G08B 21/14*** | (2006.01) |
| ***G08B 3/06*** | (2006.01) |
| ***G08B 7/06*** | (2006.01) |

(52) U.S. Cl.

CPC ..... *G08B 21/14* (2013.01); *G08B 3/06* (2013.01); *G08B 7/06* (2013.01)

(58) Field of Classification Search

None

See application file for complete search history.

(56) References Cited

U.S. PATENT DOCUMENTS

| | | | | |
|---|---|---|---|---|
| 4,469,953 | A | 9/1984 | Fujisawa et al. | |
| 5,417,204 | A | 3/1995 | Moesle | |
| 2006/0113690 | A1* | 6/2006 | Huddart | A61M 16/1075 261/129 |
| 2007/0078307 | A1* | 4/2007 | Debreczeny | A61B 5/682 600/309 |
| 2007/0163588 | A1* | 7/2007 | Hebrank | A61L 9/16 128/204.18 |
| 2008/0077020 | A1* | 3/2008 | Young | A61B 5/0205 600/484 |
| 2010/0078025 | A1* | 4/2010 | Grilliot | A62B 7/02 128/204.21 |
| 2013/0319408 | A1* | 12/2013 | Zwolinsky | A62B 9/006 128/202.22 |

* cited by examiner

*Primary Examiner* — Adolf Dsouza
(74) *Attorney, Agent, or Firm* — Gunn, Lee & Cave, PC

(57) ABSTRACT

A breathing apparatus having one or more safety sensors that monitor the breathing gas supplied to a ventilation interface for contaminants. Upon detection of a threshold value of a contaminant, the apparatus activates one of more alarms, such as strobe lights, horns and/or piezo buzzers, to waken the user to the dangerous condition. The alarm may also comprise a notification system to first responders.

12 Claims, 1 Drawing Sheet

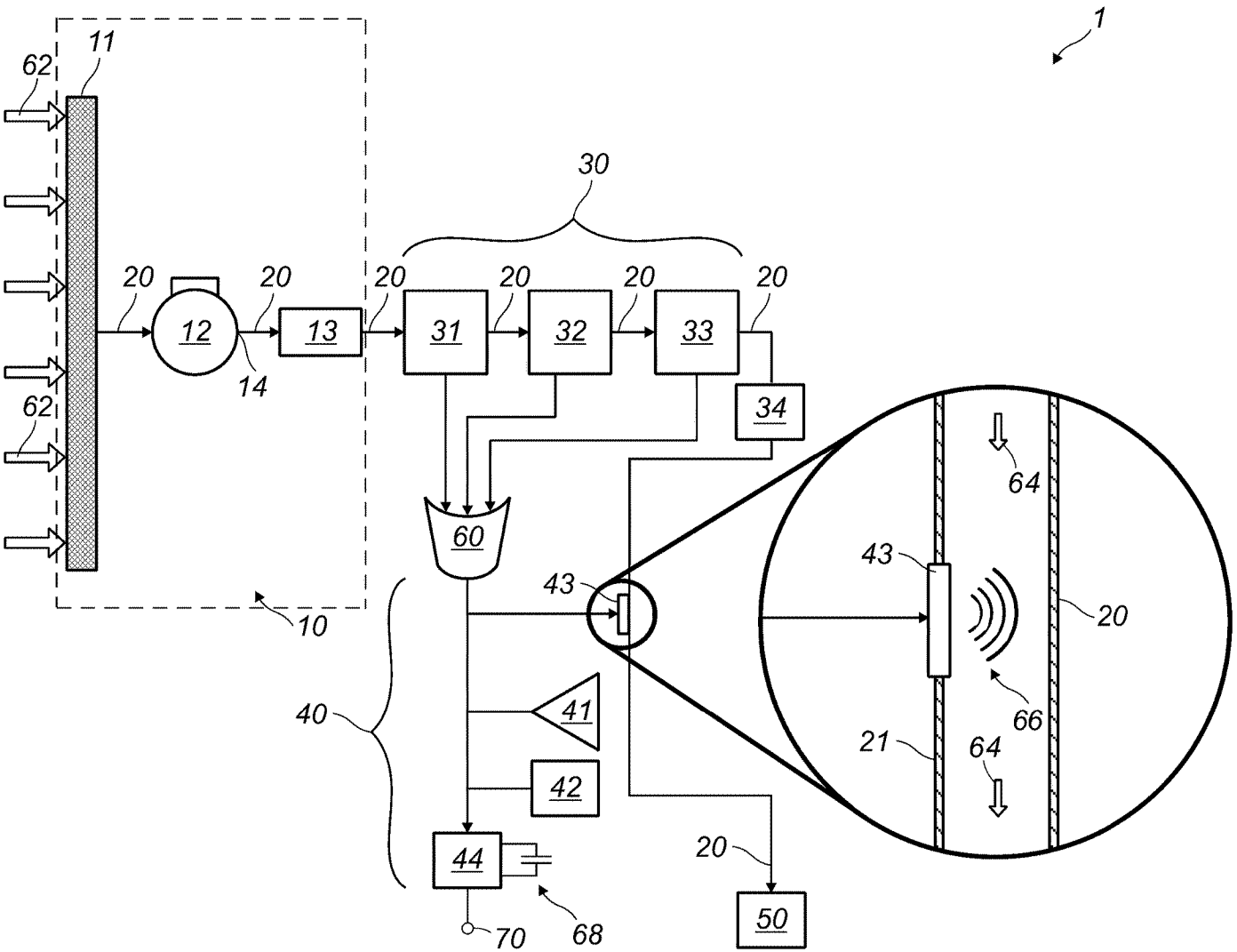
1
20
64
66
64
43
21
34
33
32
31
30
20
20
20
20
50
20
43
41
42
68
60
44
70
40
13
20
14
12
20
10
11
62
62

BREATHING APPARATUS WITH ONE OR MORE SAFETY SENSORS

CROSS-REFERENCES TO RELATED APPLICATIONS

This application claims the benefit of and priority to U.S. Provisional Application Ser. No. 62/358,082, filed Jul. 4, 2016, which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention generally relates to a breathing apparatus, such as a continuous positive airway pressure (CPAP) machine. More specifically, the invention relates to a breathing apparatus with one or more safety sensors for the detection of air contaminants.

2. Background of the Related Art

CPAP machines administer pressurized air to a user with obstructive sleep apnea (OSA). Individuals with OSA suffer from airway collapses, which can result in a hypoxic state and lowered O2 saturation of the blood. When this occurs, the body reacts violently, with the person suddenly gasping for air. Individuals with untreated OSA are subject to several serious conditions, including transient ischemic attacks, apoplectic events (strokes), and even Alzheimer's disease.

A CPAP machine works by taking ambient air, regulating it, and delivering a continuous stream of slightly pressurized air to the user via a mask or nasal cannula. The raised pressure of the air keeps the soft tissues of the nose, mouth, and throat open to prevent obstruction. Generally, the air is not treated, but some CPAP machines heat or humidify the air for the user's comfort.

While CPAP machines are effective at treating OSA, use can increase the risk of a user's inability to hear safety alarms, such as household fire or carbon monoxide (CO) alarms. Because these machines help induce REM or deep sleep in a user, it is more difficult to wake a person using external stimuli, such as noise. Moreover, CPAP machines make noise that may drown out alarms, and some users of CPAP machines suffer hearing loss. As a result of that noise, a person using a CPAP machine may not hear a smoke alarm, carbon monoxide detector, or sense a contaminated or noxious atmosphere. Furthermore, despite the use of filters, CPAP machines still deliver some contaminants to the user.

SUMMARY OF THE INVENTION

The present invention addresses these problems by sensing excessive levels of CO, soot particulate, and/or ionized particles. When sensed, a local alarm is sounded to wake the user through audible and visual means. An output is also provided to electrically or wirelessly connect to an alarm system or dispatching system to notify a fire department or other third party.

It is an aim of this invention to actively sample gasses delivered to the user and to alert the user if contaminants or toxic gasses are present.

It is a further aim of this invention to continuously sample incoming air to be delivered to a CPAP user for CO (carbon monoxide), soot particulate, and ions from a fire and to alert the user that a hazard exists.

It is a further aim of this invention to alert the user by both aural and visual means that a hazard exists.

It is also a goal of this invention to have a relay contact closure tied into an existing fire alarm system, or to have a signal sent wirelessly to a dispatching service or public sector agency.

It is a further goal to modulate the air pressure of the delivered air gas to the user with an audible tone so as to further alert the user of the alarm condition.

BRIEF SUMMARY OF THE DRAWINGS

FIG. 1 is a block diagram of an embodiment of the invention.

DETAILED DESCRIPTION

Referring to FIG. 1, one embodiment 1 of the invention includes an air flow generator 10, a conduit 20, safety sensors 30, alarms 40, and a ventilation interface 50. The air flow generator 10 includes a 40-micron dust filter 11, compressor 12 with an outflow port 14, and a regulator 13. The regulator 13 is a pressure regulator used to control the pressure of the airflow. The safety sensors 30 include a carbon monoxide (CO) detector 31, a soot detector 32, and/or an ion detector 33. A 0.3-micron HEPA filter 34 is positioned downstream of the safety sensors 30.

The alarm signals 40 include a strobe light 41, a horn 42, a piezo buzzer 43, and a third-party emergency notification system 44. The ventilation interface 50 is a mask, but may alternatively be a mouthpiece or any other device commonly used to act as the interface for a user to receive air. A conduit 20 provides an air pathway from the outflow port 14 of the compressor 12 to the ventilation interface 50. The regulator 13, safety sensors 30, and ventilation interface 50 are interconnected with the conduit 20. In other embodiments, however, the safety sensors may be located within the ventilation interface 50.

In operation, ambient air 62 is drawn by the compressor 12 through the filter 11, which removes particulate from the air that is larger than 40 microns. The dust filter 11 does not remove soot particular resultant from a fire, which is about 2.5 microns in size. The compressed and filtered air exits the outflow port 14 into the conduit 20, where it is conditioned/regulated by the regulator 13 and provided as regulated air 64. The air may be regulated for pressure based on user comfort and medical requirements.

The regulated air 64 continues through the conduit 20 to the safety sensors 30, which include a CO detector 31, a soot detector 32, and an ion detector 33. Each sensor is in fluid communication with the conduit 20 allowing access to the regulated air 64.

The CO detector 31 is configured to detect a certain level of CO, such as the OSHA limit of 50 ppm or NIOSH level of 35 ppm. If the CO detector 31 measures CO within a specified parameter, such as greater than 35 or 50 ppm, a logical output "1" signal is generated and fed to a logical OR gate 60; otherwise, the CO detector 33 outputs a logical "0." An example of a suitable CO detector is circuitry based on the Integrated Circuit (IC) RE46C800 made by Microchip of Chandler, Ariz.

The soot detector 32 senses the presence of soot through use of photoelectric means. Specifically, an infrared LED is used to flash infrared pulses into a chamber containing the regulated air 64. If soot particulate is present, the IR light pulses reflect off the soot particulate and are detected by an optical transistor or photodiode composing the detector 32. If the soot detector 32 detects a level of soot based on a predetermined parameter, a logical output "1" signal is generated and fed to the logical OR gate 60; otherwise, the soot detector 32 outputs a logical "0." An example of a suitable soot detector is circuitry based on the Integrated Circuit (IC) RE46C140 manufactured by Microchip brand of Chandler, Ariz.

The ion detector 33 detects the presence of ions that are typically generated by flame combustion. The ion detector 33 senses a current flow based on radioactive emissions from a source pellet of Americium 241. Ionized smoke particles, if present, disrupt the current flow. If the ion detector 33 detects a disruption of current of a predetermined amount, a logical output "1" signal is generated and fed to the logical OR gate 60; otherwise, the ion detector 33 outputs a logical "0." An example of a suitable ion detector is the circuit described by Freescale Semiconductor of Tempe, Ariz. utilizing the IC known in the art as MC14668.

After regulated air 64 passes through the safety sensors 30 via conduit 20, it passes through the HEPA filter 34. The HEPA filter 34 works downstream from the safety sensors 30 to insure that airborne soot particles are not provided to the ventilation interface 50.

The safety sensors 30 are individually directly connected to the OR gate 60. The OR gate 60 generates an output signal of logical output "1" if it receives a logical output "1" from any of the safety sensors 30. Once activated, the OR gate 60 sends a signal to the safety alarms 40. This activates the strobe light 41, the horn 42, the piezo buzzer 43, and the third-party emergency notification system 44. Thus, each of the strobe light 41, horn 42, piezo buzzer 43, and notification system 44 is indirectly connected to each of the CO detector 31, soot detector 32, and ion detector 33 through the OR gate 60.

The strobe light 41 provides a visual cue, and the horn 42 provides an auditory cue, to awaken and alert the user. The strobe light 41 and horn 42 may be physically connected to the device or placed remotely.

The piezo buzzer 43 is located within the sidewall 21 of the conduit 20. When activated, the piezo buzzer 43 modulates the regulated air 64 being supplied to the user, effectively transmitting sound waves 66 into the oral and/or nasal cavities. The sound waves 66 create a vibration that will awaken or alert the user.

The third-party emergency notification system 44 ties into an existing home alarm system or other commercially available alarm system that provides notification to the whole home and/or a third-party system that contacts emergency first responders. In this embodiment, for example, the system 44 provides a contact closure 68 or a DC signal 70 to tie into an existing fire alarm system.

In alternative embodiments, the strobe light 41, horn 42, piezo buzzer 43, and third-party emergency notification system 44 may be activated through wireless means such as RF transmission. For example, the OR gate 60 may send a signal to a transmitter that is wirelessly connected to receivers located on the strobe light 41, horn 42, piezo buzzer 43, and the third-party emergency notification system 44.

The present invention is described in terms of a specific embodiment of a breathing apparatus with one or more safety sensors. Those skilled in the art will recognize that alternative constructions of such an apparatus can be used in carrying out the present invention and may be applied to any breathing device, including those that draw air from a designated supply tank. For example, this invention may be applied to any self-contained breathing apparatus such as those used in SCUBA diving and by first responders such as fire fighters. Moreover, while the present invention teaches the use of specific safety sensors to monitor the regulated air being delivered to a user, other safety sensors may be implemented to detect other types of air contaminants. Other aspects, features, and advantages of the present invention may be obtained from a study of this disclosure and the drawings, along with the appended claims.

I claim:

1. A breathing apparatus comprising:

a compressor having an inflow of ambient air and an outflow;

a ventilation interface;

a conduit in fluid communication with the outflow of the compressor and the ventilation interface;

at least one sensor in fluid communication with the outflow of the compressor capable of measuring at least one combustion generated contaminant within the ambient air-having an output;

at least one alarm connected to the output of the at least one sensor; and a filter within the conduit downstream from the at least one sensor.

2. The apparatus of claim 1 wherein the output is determined based on a threshold value of the at least one combustion generated contaminant.

3. The apparatus of claim 1 wherein the at least one sensor is a carbon monoxide detector.

4. The apparatus of claim 1 wherein the sensor is a photoelectric sensor.

5. The apparatus of claim 1 wherein the sensor is an ion detector.

6. The apparatus of claim 1 wherein the at least one alarm is a strobe light.

7. The apparatus of claim 1 wherein the at least one alarm is a horn.

8. The apparatus of claim 1 wherein the at least one alarm is a piezo buzzer at least partially within the conduit.

9. The apparatus of claim 1 further comprises a third-party notification system connected to an alarm.

10. The apparatus of claim 2 further comprising an indicator light having an input connected to the output of the at least one sensor.

11. The apparatus of claim 1 wherein the at least one alarm generates a vibration through the conduit.

12. The apparatus of claim 1 wherein the at least one alarm modulates the air pressure in the conduit.

* * * * *